US012721487B2

(12) United States Patent
Innes et al.

(10) Patent No.: US 12,721,487 B2
(45) Date of Patent: Sep. 1, 2026

(54) VACUUM CLEANER

(71) Applicant: SHARKNINJA OPERATING LLC, Needham, MA (US)

(72) Inventors: Daniel Innes, Worthing (GB); Casey McClay, Medford, MA (US); Daniel Meyer, Boston, MA (US); Xiaojun Zhu, Suzhou City (CN); Guoyang Zhong, Suzhou City (CN); Baoquan Yang, Suzhou City (CN); Xin Li, Suzhou City (CN); GuoJiang Qu, Suzhou City (CN)

(73) Assignee: SharkNinja Operating LLC, Needham, MA (US)

( * ) Notice: Subject to any disclaimer, the term of this patent is extended or adjusted under 35 U.S.C. 154(b) by 517 days.

(21) Appl. No.: 18/205,352

(22) Filed: Jun. 2, 2023

(65) Prior Publication Data

US 2024/0349964 A1 Oct. 24, 2024

Related U.S. Application Data

(63) Continuation of application No. PCT/CN2023/089384, filed on Apr. 20, 2023.

(51) Int. Cl.
*A47L 9/10* (2006.01)
*A47L 9/12* (2006.01)

(52) U.S. Cl.
CPC .. *A47L 9/10* (2013.01); *A47L 9/12* (2013.01)

(58) Field of Classification Search
CPC ... A47L 9/127; A47L 5/24; A47L 9/10; A47L 9/12

(Continued)

(56) References Cited

U.S. PATENT DOCUMENTS 6,612,625 B1 * 9/2003 Barber ..... G03F 7/70741 292/87
2013/0058635 A1 3/2013 Vrdoljak (Continued)

FOREIGN PATENT DOCUMENTS

CN 109793458 5/2019
CN 112969393 6/2021

(Continued)

OTHER PUBLICATIONS

PCT Search Report and Written Opinion mailed Jan. 20, 2024, received in corresponding PCT Application No. PCT/CN23/89384, 10 pages.

*Primary Examiner* — Bryan R Muller
(74) *Attorney, Agent, or Firm* — Secant IP, P.L.L.C.

(57) ABSTRACT

A vacuum cleaner may include a suction motor, a body defining a filter cavity, the filter cavity being fluidly coupled to the suction motor and configured to receive a filter, a filter cover removably coupled to the body, the filter cover extending over at least a portion of the filter cavity, and a release configured to transition between a releasing position and a retaining position to removably couple the filter cover to the body. The release may include a body release portion, at least a portion of the body release portion being rotatably coupled to the body and a cover release portion, at least a portion of the cover release portion being slidably coupled to the filter cover, wherein a rotational movement of the body release portion causes a corresponding linear movement in the cover release portion to transition the release between the releasing position and the retaining position.

20 Claims, 12 Drawing Sheets

(58) Field of Classification Search
USPC ..... 292/87, 285, 303, 341.17
See application file for complete search history.

(56) References Cited

U.S. PATENT DOCUMENTS

| | | | |
|---|---|---|---|
| 2013/0152337 | A1 | 6/2013 | Thorne |
| 2014/0150201 | A1 | 6/2014 | Mcgee et al. |
| 2015/0013102 | A1 | 1/2015 | Bilger |
| 2015/0040340 | A1 | 2/2015 | Bilger et al. |
| 2015/0135474 | A1 | 5/2015 | Gidwell |
| 2015/0297054 | A1 | 10/2015 | Weeks et al. |
| 2015/0351596 | A1 | 12/2015 | Thorne |
| 2016/0128530 | A1 | 5/2016 | Thorne et al. |
| 2016/0174793 | A1 | 6/2016 | Burke et al. |
| 2016/0220080 | A1 | 8/2016 | Thorne |
| 2016/0220081 | A1 | 8/2016 | Xu et al. |
| 2016/0220082 | A1 | 8/2016 | Thorne et al. |
| 2016/0324388 | A1 | 11/2016 | Vrdoljak et al. |
| 2016/0374533 | A1 | 12/2016 | Innes et al. |
| 2017/0042319 | A1 | 2/2017 | Conrad et al. |
| 2017/0112343 | A1 | 4/2017 | Innes et al. |
| 2017/0127896 | A1 | 5/2017 | Carter et al. |
| 2017/0144810 | A1 | 5/2017 | Birdsell |
| 2017/0215667 | A1 | 8/2017 | Thorne et al. |
| 2017/0347848 | A1 | 12/2017 | Carter et al. |
| 2018/0035854 | A1 | 2/2018 | Thorne |
| 2018/0064301 | A1 | 3/2018 | Cottrell et al. |
| 2018/0068815 | A1 | 3/2018 | Cottrell |
| 2018/0070785 | A1 | 3/2018 | Udy et al. |
| 2018/0255991 | A1 | 9/2018 | Der Marderosian et al. |
| 2018/0296046 | A1 | 10/2018 | Thorne et al. |
| 2018/0306432 | A1 | 10/2018 | Ognjen et al. |
| 2018/0325252 | A1 | 11/2018 | Hopke et al. |
| 2018/0338654 | A1 | 11/2018 | Kelsey |
| 2018/0338656 | A1 | 11/2018 | Carter et al. |
| 2019/0038098 | A1 | 2/2019 | Thorne et al. |
| 2019/0059668 | A1 | 2/2019 | Thorne et al. |
| 2019/0069740 | A1 | 3/2019 | Thorne et al. |
| 2019/0069744 | A1 | 3/2019 | Liggett et al. |
| 2019/0090701 | A1 | 3/2019 | Tonderys et al. |
| 2019/0090705 | A1 | 3/2019 | Thorne et al. |
| 2019/0191947 | A1 | 6/2019 | Freese et al. |
| 2019/0193120 | A1 | 6/2019 | Brown et al. |
| 2019/0246853 | A1 | 8/2019 | Sardar et al. |
| 2019/0274500 | A1 | 9/2019 | Thorne et al. |
| 2019/0274501 | A1 | 9/2019 | Antonisami et al. |
| 2019/0302793 | A1 | 10/2019 | Leech et al. |
| 2019/0320865 | A1 | 10/2019 | Brown et al. |
| 2019/0320866 | A1 | 10/2019 | Thorne et al. |
| 2019/0335968 | A1 | 11/2019 | Harting et al. |
| 2019/0343349 | A1 | 11/2019 | Clare et al. |
| 2019/0357740 | A1 | 11/2019 | Thorne et al. |
| 2020/0000298 | A1 | 1/2020 | Brown et al. |
| 2020/0022543 | A1 | 1/2020 | Gill et al. |
| 2020/0022544 | A1 | 1/2020 | Gill et al. |
| 2020/0022553 | A1 | 1/2020 | Gill et al. |
| 2020/0037833 | A1 | 2/2020 | Niedzwecki et al. |
| 2020/0037843 | A1 | 2/2020 | Fiebig et al. |
| 2020/0046184 | A1 | 2/2020 | Freese et al. |
| 2020/0077855 | A1 | 3/2020 | Brown et al. |
| 2020/0085267 | A1 | 3/2020 | Thorne et al. |
| 2020/0085269 | A1 | 3/2020 | Thorne |
| 2020/0121144 | A1 | 4/2020 | Gacin et al. |
| 2020/0121148 | A1 | 4/2020 | Hoffman et al. |
| 2020/0138260 | A1 | 5/2020 | Sutter et al. |
| 2020/0166949 | A1 | 5/2020 | Leech et al. |
| 2020/0170470 | A1 | 6/2020 | Liggett et al. |
| 2020/0201348 | A1 | 6/2020 | Leech |
| 2020/0205631 | A1 | 7/2020 | Brown et al. |
| 2020/0205634 | A1 | 7/2020 | Sutter et al. |
| 2020/0237171 | A1 | 7/2020 | Xu et al. |
| 2020/0288929 | A1 | 9/2020 | Brunner |
| 2020/0288930 | A1 | 9/2020 | Wells |
| 2020/0297172 | A1 | 9/2020 | Tonderys et al. |
| 2020/0301430 | A1 | 9/2020 | Irkliy et al. |
| 2020/0315418 | A1 | 10/2020 | Howard et al. |
| 2020/0345196 | A1 | 11/2020 | Innes et al. |
| 2020/0367711 | A1 | 11/2020 | Thorne et al. |
| 2020/0371526 | A1 | 11/2020 | Kamada |
| 2020/0383547 | A1 | 12/2020 | Sutter et al. |
| 2021/0007569 | A1 | 1/2021 | Howard et al. |
| 2021/0022574 | A1 | 1/2021 | Harting |
| 2021/0030227 | A1 | 2/2021 | Mathieu et al. |
| 2021/0038032 | A1 | 2/2021 | Brown |
| 2021/0059495 | A1 | 3/2021 | Gill et al. |
| 2021/0085144 | A1 | 3/2021 | Woodrow et al. |
| 2021/0169289 | A1 | 6/2021 | Thorne et al. |
| 2021/0175772 | A1 | 6/2021 | Aini |
| 2021/0177223 | A1 | 6/2021 | Der Marderosian et al. |
| 2021/0186282 | A1 | 6/2021 | Mathieu et al. |
| 2021/0204684 | A1 | 7/2021 | Heman-Ackah et al. |
| 2021/0254615 | A1 | 8/2021 | Vrdoljak et al. |
| 2021/0307581 | A1 | 10/2021 | Thorne et al. |
| 2021/0315428 | A1 | 10/2021 | Udy et al. |
| 2021/0386261 | A1 | 12/2021 | Woodrow et al. |
| 2021/0386262 | A1 | 12/2021 | Uchendu et al. |
| 2022/0031131 | A1 | 2/2022 | McClay et al. |
| 2022/0031133 | A1 | 2/2022 | Der Marderosian et al. |
| 2022/0031134 | A1 | 2/2022 | Yang et al. |
| 2022/0061614 | A1 | 3/2022 | Yu et al. |
| 2022/0071459 | A1 | 3/2022 | Gacin et al. |
| 2022/0095864 | A1 | 3/2022 | Der Marderosian et al. |
| 2022/0125256 | A1 | 4/2022 | Lessard et al. |
| 2022/0287521 | A1 | 9/2022 | Cottrell et al. |
| 2022/0322903 | A1 | 10/2022 | Lessard |
| 2022/0400922 | A1 | 12/2022 | McClay et al. |
| 2022/0408994 | A1 | 12/2022 | Hill |
| 2023/0043567 | A1 | 2/2023 | Copeland et al. |
| 2023/0070147 | A1 | 3/2023 | Harting et al. |
| 2023/0157495 | A1 | 5/2023 | Copeland et al. |
| 2023/0248192 | A1 | 8/2023 | Brown et al. |
| 2023/0320550 | A1 | 10/2023 | Teuscher et al. |
| 2023/0329502 | A1 | 10/2023 | Chirikjian |
| 2023/0355065 | A1 | 11/2023 | Finnegan |
| 2023/0414052 | A1 | 12/2023 | McClay et al. |
| 2024/0008699 | A1 | 1/2024 | Innes et al. |
| 2024/0415352 | A1 | 12/2024 | McClay et al. |

FOREIGN PATENT DOCUMENTS

| | | | | |
|---|---|---|---|---|
| CN | 214208224 | | 9/2021 | |
| CN | 215777757 | | 2/2022 | |
| CN | 215777757 U | * | 2/2022 | |
| CN | 215777758 | | 2/2022 | |
| CN | 215777768 | | 2/2022 | |
| CN | 217959939 | | 12/2022 | |
| CN | 110893081 B | * | 10/2023 | ..... A47L 5/24 |
| DE | 102012100050 | | 7/2013 | |
| EP | 3906829 | | 11/2021 | |

* cited by examiner

VACUUM CLEANER

CROSS REFERENCE TO RELATED APPLICATIONS

The present application is a continuation of PCT application PCT/CN2023/089384, filed Apr. 20, 2023, which is fully incorporated herein by reference.

TECHNICAL FIELD

The present disclosure is generally directed to a vacuum cleaner and more specifically to a filter and filter housing of a vacuum cleaner.

BACKGROUND INFORMATION

Vacuum cleaners are configured to remove debris from a surface to be cleaned (e.g., a floor) using suction. For example, a vacuum cleaner may include an air inlet, an air outlet, a dust cup, and a suction motor. The suction motor is configured to draw air from the air inlet and into the dust cup. At least a portion of any debris entrained within the air flowing into the dust cup is deposited within the dust cup for later disposal. The suction motor is configured to cause air to flow from the dust cup and to the air outlet. Air flowing from the air outlet is returned to the surrounding environment. As such, in some instances, a filter may be disposed within the air path at location between the suction motor and the air outlet. The filter may be configured to capture at least a portion of any remaining debris entrained within the air before entering the surrounding environment. Overtime, the performance of the filter may be degraded as a result of the collection of debris. As such, the filter may be replaced or cleaned to restore performance of the filter.

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a vacuum cleaner. The vacuum cleaner includes a suction motor, a filter cavity fluidly coupled to the suction motor, the filter cavity being configured to receive a filter, and a filter cover selectively enclosing the filter cavity. The filter cover being configured to transition from a closed position to an open position in response to actuation of a release. The release includes a rotatable portion and a sliding portion, the sliding portion being configured to slide in response to rotation of the rotating portion.

Figure 1:
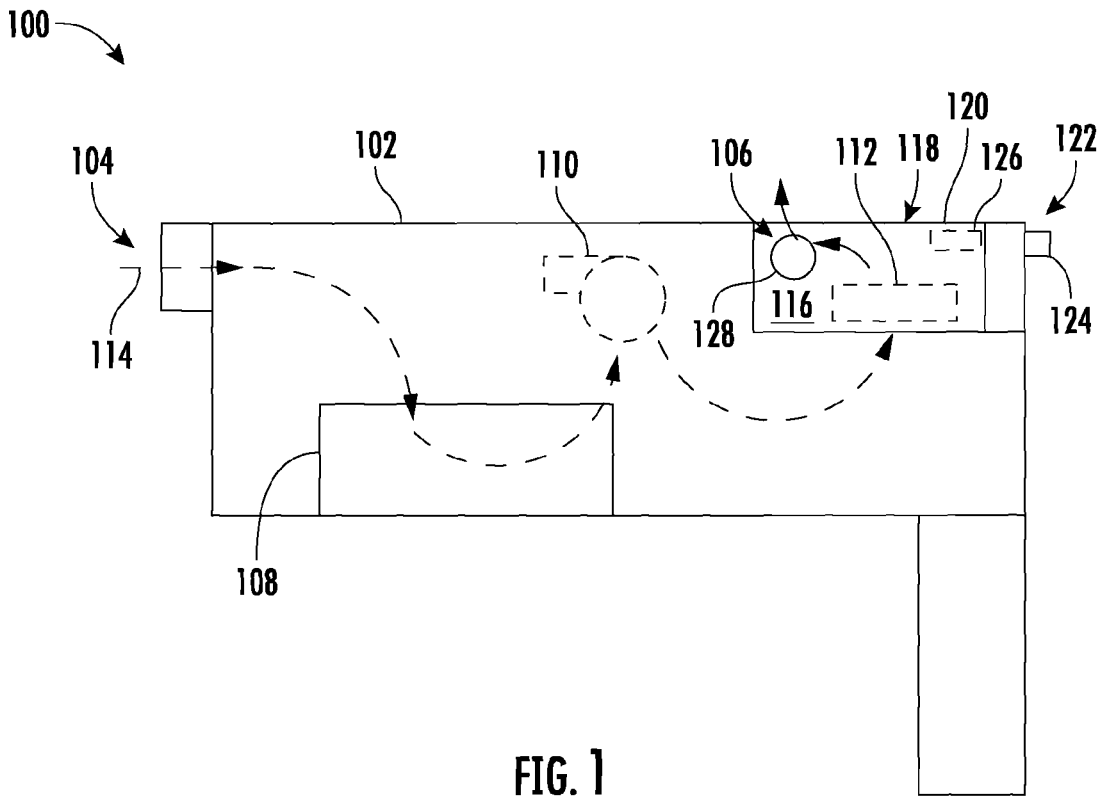
FIG. 1 shows a schematic example of a vacuum cleaner, consistent with embodiments of the present disclosure.

FIG. 1 is a schematic example of a vacuum cleaner 100. The vacuum cleaner 100 includes a body 102, an air inlet 104, an air outlet 106, a dust cup 108 coupled (e.g., removably and/or pivotally coupled) to the body 102, and a suction motor 110 coupled to the body 102 and configured to cause air to flow into the air inlet 104, through the dust cup 108, and out the air outlet 106. A post-motor filter 112 may be disposed downstream of the suction motor 110 and upstream of the air outlet 106. In other words, the post-motor filter 112 may be disposed along an air path 114 extending through the body 102 at a location between the suction motor 110 and the air outlet 106.

The body 102 defines a filter cavity 116 fluidly coupled to the suction motor 110. The post-motor filter 112 is removably disposed within the filter cavity 116. The filter cavity 116 has an open end 118 through which the post-motor filter 112 may be inserted into or removed from the filter cavity 116. A filter cover 120 may be coupled (e.g., removably or pivotally) to the body 102 such that the filter cover 120 extends over at least a portion of the filter cavity 116 and/or the post-motor filter 112 (e.g., to selectively enclose at least a portion of the open end 118 of the filter cavity 116). For example, the filter cover 120 may be configured to transition between an open position and a closed position, wherein the post-motor filter 112 is removable from the filter cavity 116 when the filter cover 120 is in the open position.

A release 122 is configured to transition between a releasing position and a retaining position to selectively retain the filter cover 120 in the closed position. When the release 122 is in the retaining position, the release retains the filter cover 120 in the closed position. When the release 122 is in the releasing position, the filter cover 120 can be transitioned to the open position.

The release 122 includes a body release portion 124 movably coupled to the body 102 and a cover release portion 126 movably coupled to the filter cover 120. The body release portion 124 is configured to cooperate with the cover release portion 126 to selectively retain the filter cover 120 in the closed position. For example, at least a portion of the body release portion 124 may be rotatably coupled to the body 102 and at least a portion of the cover release portion 126 may be slidably coupled to the filter cover 120. In this example, a rotational movement of the body release portion 124 causes a corresponding linear movement in the cover release portion 126. Linear movement of the cover release portion 126 transitions the release 122 between the retaining and releasing positions.

In some instances, the filter cover 120 may include one or more vents 128 which define at least a portion of the air outlet 106. As such, air exiting the post-motor filter 112 passes through at least one of the one or more vents 128 and into a surrounding environment. The post-motor filter 112 may be a pleated filter, a foam filter, and/or any other filter medium. In some instances, the post-motor filter 112 may be a high efficiency particulate air (HEPA) filter.

Figure 2:
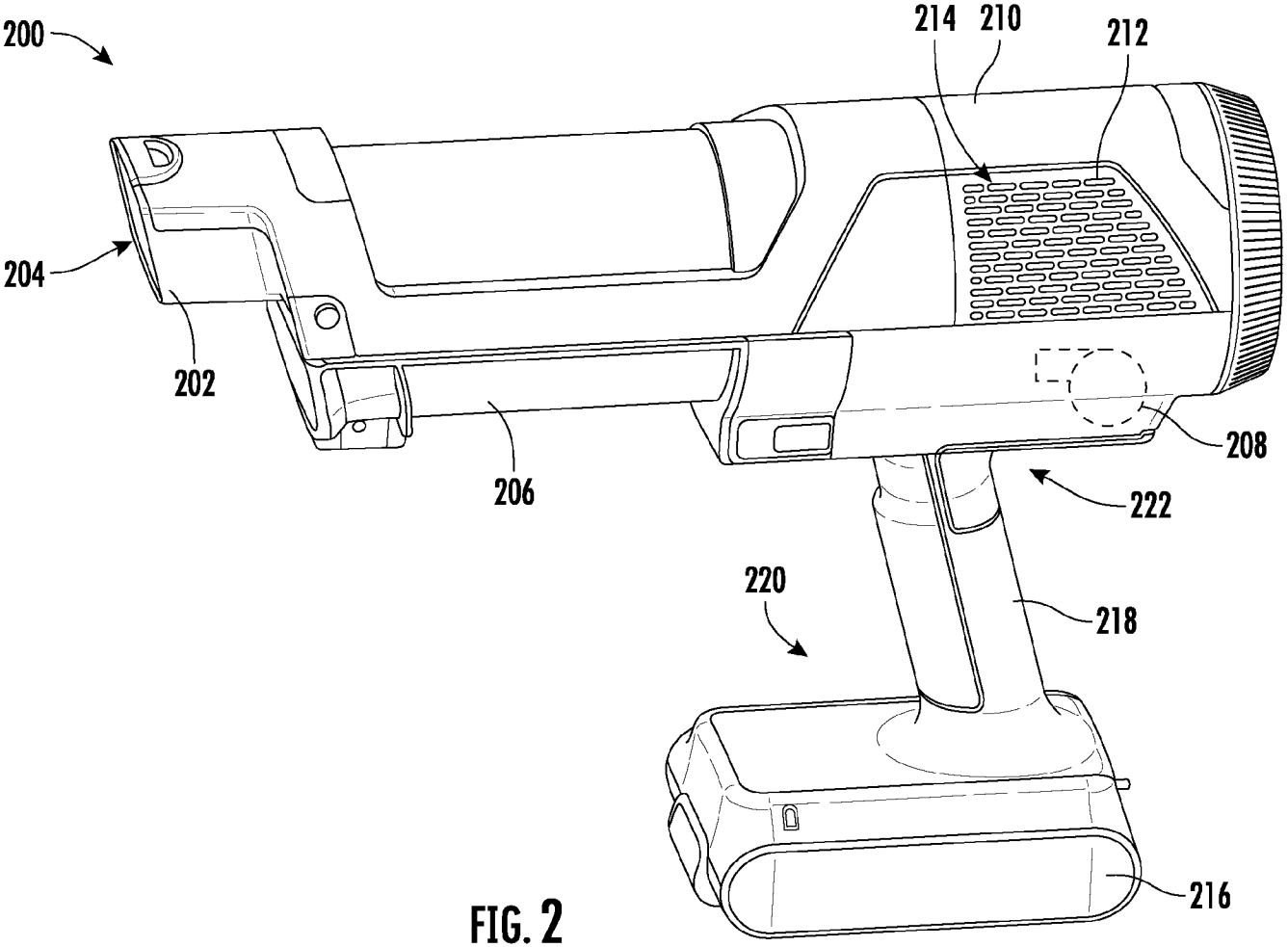
FIG. 2 shows a perspective view of a vacuum cleaner, consistent with embodiments of the present disclosure.

FIG. 2 shows a perspective view of a vacuum cleaner 200, which is an example of the vacuum cleaner 100 of FIG. 1. As shown, the vacuum cleaner 200 includes a nozzle 202 defining an air inlet 204, a dust cup 206 fluidly coupled to the nozzle 202, a suction motor 208 (shown schematically in hidden lines), and a filter cover 210 that includes one or more vents 212 that define at least a portion of an air outlet 214. The vacuum cleaner 200 may, in some instances, be powered by a battery 216. The battery 216 may be coupled to a hand grip 218. For example, and as shown, the battery 216 may be coupled to a first distal end 220 of the hand grip 218, wherein the first distal end 220 is opposite a second distal end 222 of the hand grip 218 and the second distal end 222 is closer to the dust cup 206 than the first distal end 220.

Figure 3:
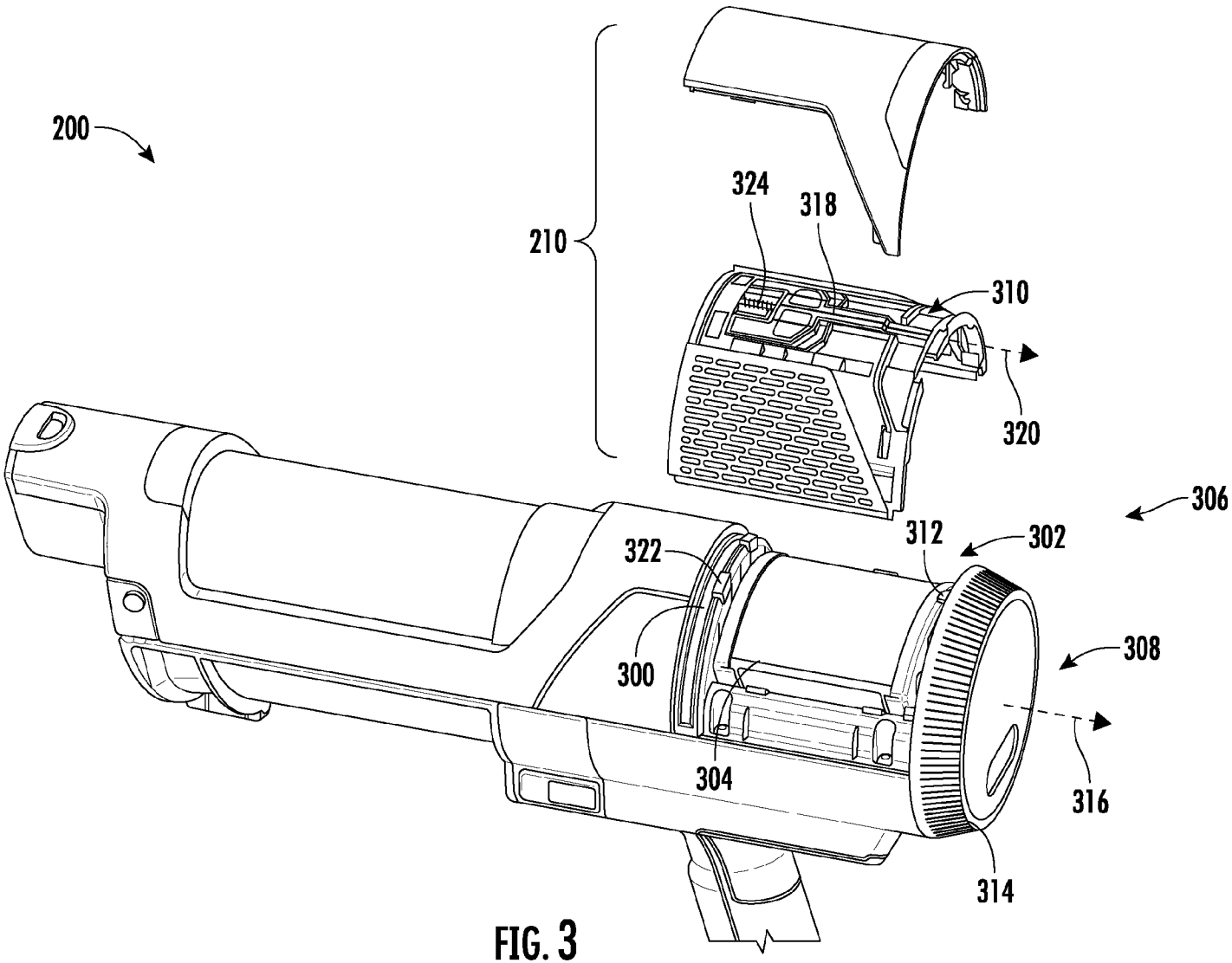
FIG. 3 shows a partial exploded view of the vacuum cleaner of FIG. 2, consistent with embodiments of the present disclosure.

FIG. 3 shows a perspective exploded view of a portion of the vacuum cleaner 200 of FIG. 2. As shown, the vacuum cleaner 200 includes a body 300 defining a filter cavity 302 configured to removably receive a filter 304 (e.g., a post-motor filter) and a release 306 to selectively couple the filter cover 210 to the body 300. For example, the release 306 can be configured to transition between a releasing position (e.g., the filter cover 210 is removable from the body 300) and a retaining position (e.g., the release 306 is configured to prevent removal of the filter cover 210 from the body 300). As shown, the filter cover 210 is configured to at least partially enclose the filter cavity 302, retaining the filter 304 within the filter cavity 302. The body 300 may be a single piece or multi-piece body.

The release 306 includes a body release portion 308 and a cover release portion 310. As shown, the body release portion 308 includes a protrusion 312 and a rotation ring 314. The protrusion 312 is configured to rotate with the rotation ring 314. The rotation ring 314 is configured to rotate about an actuation rotation axis 316. The cover release portion 310 includes a latch 318 configured to move linearly along a latch axis 320. The latch axis 320 may extend substantially (e.g., with 1% of, 2% of, 3% of, 4% of, or 5% of) parallel to the actuation rotation axis 316. The latch 318 is configured to selectively engage one or more latch catches 322 of the body 300 (e.g., formed from or coupled to the body 300) to selectively couple the filter cover 210 to the body 300. The latch 318 is configured to transition between a latched position and an unlatched position in response to rotational movement of the rotation ring 314 about the actuation rotation axis 316. For example, the protrusion 312 can be configured to engage (e.g., contact) the latch 318 such that rotational movement of the protrusion (as a result of the rotation of the rotation ring 314) causes the latch 318 to be transitioned between the latched and unlatched positions.

As shown, the latch 318 is biased towards the unlatched position (or out of engagement with the one or more latch catches 322) using a biasing mechanism 324 (e.g., a spring). As such, in these instances, the protrusion 312 is configured to be in engagement with the latch 318 when the release 306 is in the retaining position and is configured to be substantially out of engagement with the latch 318 when the release 306 is in the releasing position. In other words, engagement between the protrusion 312 and the latch 318 prevents the latch 318 from disengaging the one or more latch catches 322 as a result of the biasing force of the biasing mechanism 324.

Figure 4:
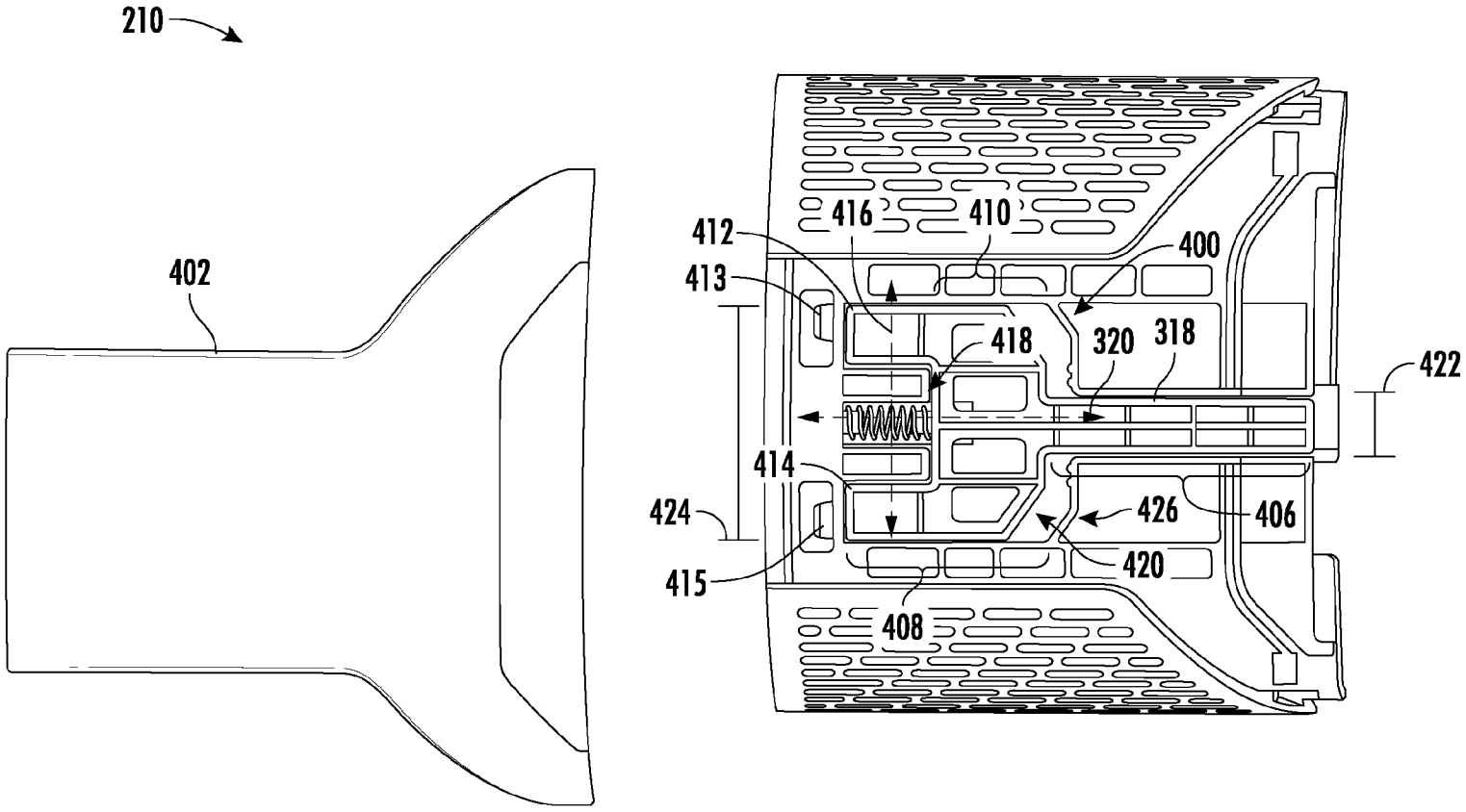
FIG. 4 shows a partial exploded view of a filter cover of the vacuum cleaner of FIG. 2, consistent with embodiments of the present disclosure.

FIG. 4 shows an exploded perspective view of the filter cover 210. As shown, the filter cover 210 includes a latch cavity 400 and an overlay 402 configured to enclose the latch cavity 400. The latch cavity 400 is configured movably receive at least a portion of the latch 318. For example, latch 318 may be slidable within the latch cavity 400 in response to a rotation of at least a portion of the body release portion 308 (e.g., the rotation ring 314).

Figure 4A:
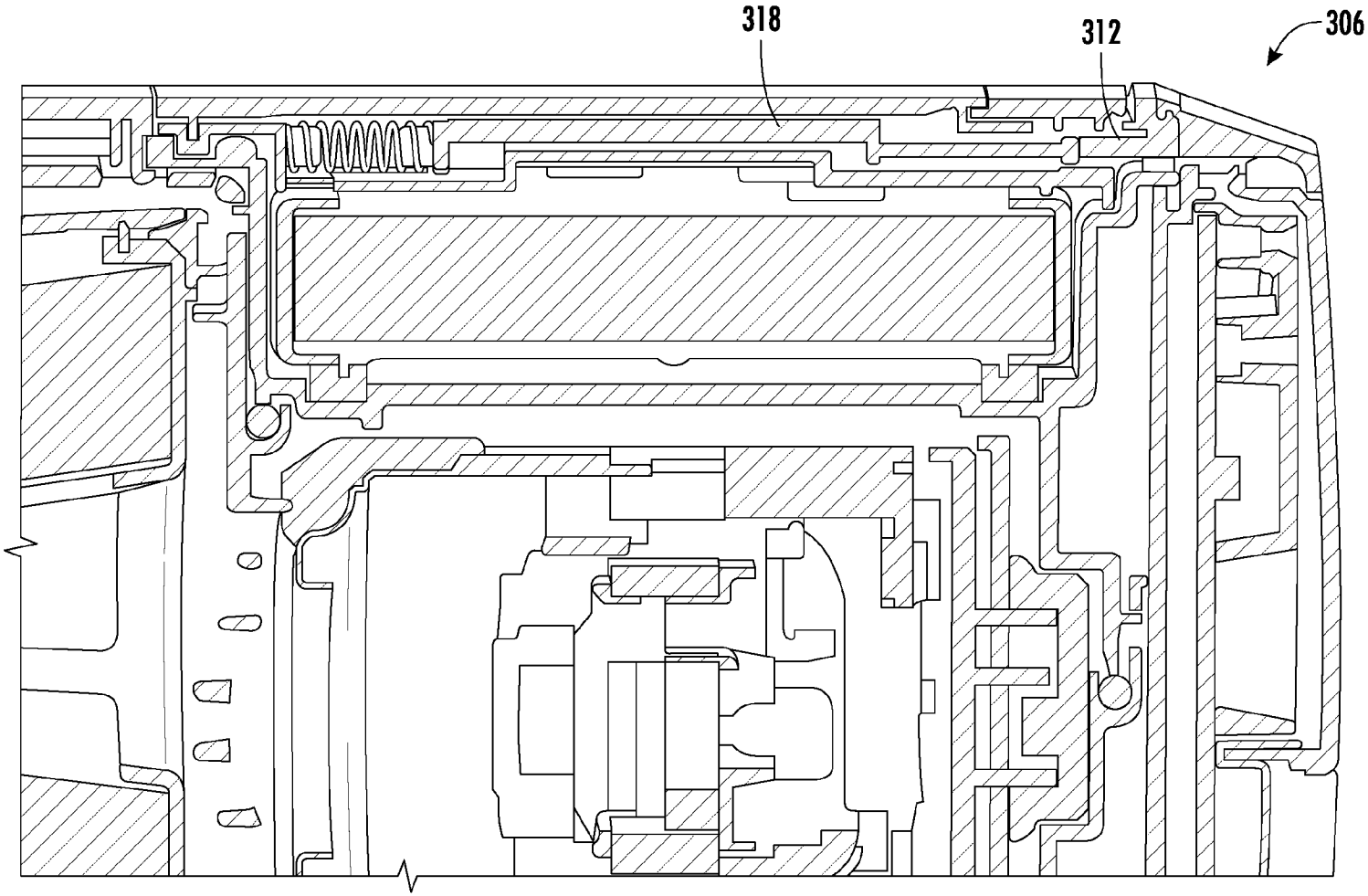
FIG. 4A shows a magnified cross-sectional view of a portion of the vacuum cleaner of FIG. 2, consistent with embodiments of the present disclosure.
Figure 4B:
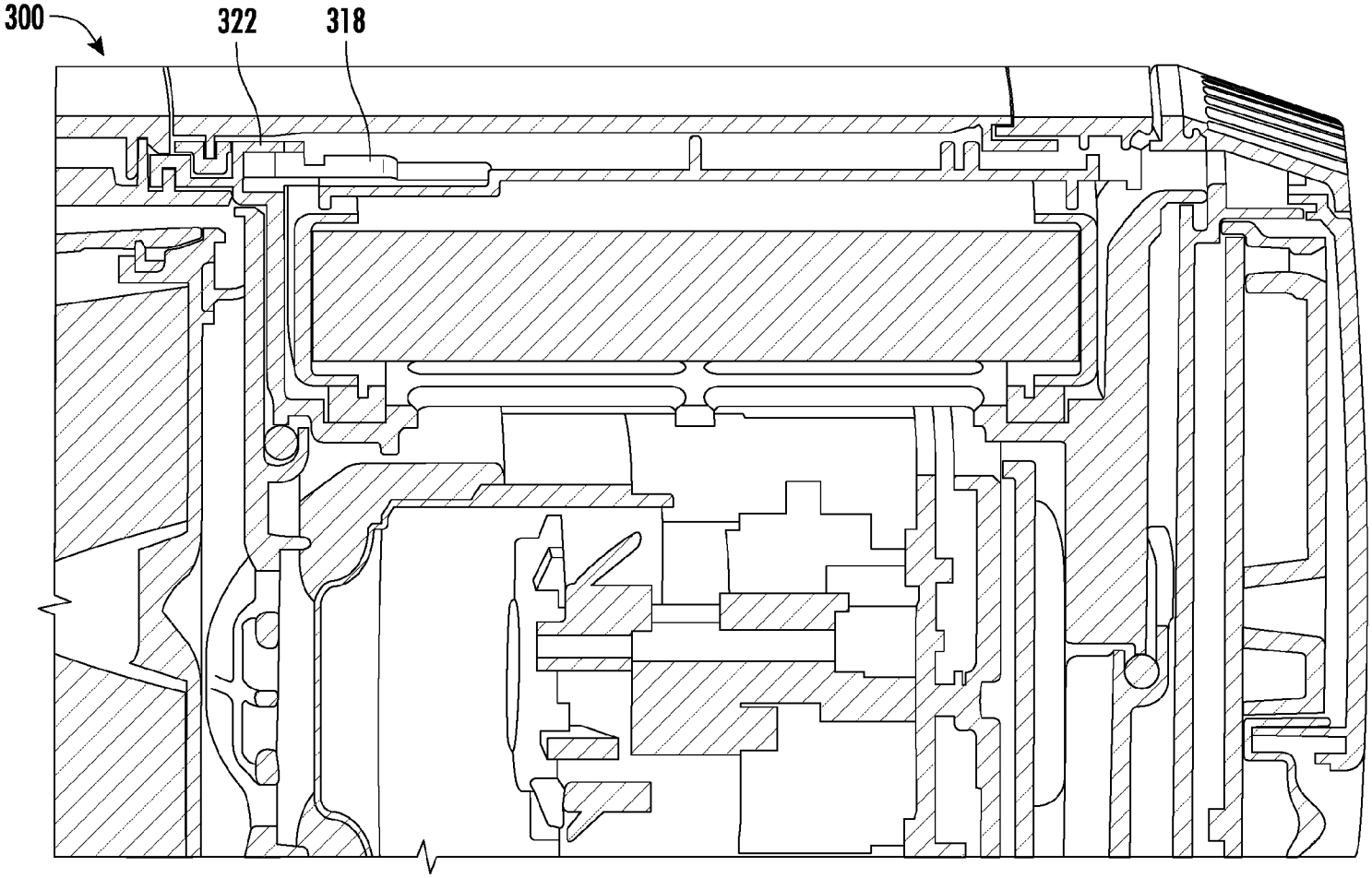
FIG. 4B shows another magnified cross-sectional view of a portion of the vacuum cleaner of FIG. 2, consistent with embodiments of the present disclosure.

As shown, the latch 318 includes an actuated portion 406 configured to be engaged with the body release portion 308 (e.g., the protrusion 312) (FIG. 4A) and an actuation portion 408 configured to selectively engage with the body 300 (e.g., the one or more latch catches 322) (FIG. 4B). The actuation portion 408 may include a base region 410, a first leg 412 extending from the base region 410 and a second leg 414 extending from the base region 410. The first leg 412 is spaced apart from the second leg 414 along a separation axis 416 that extends transverse to (e.g., perpendicular to) the latch axis 320 to form a biasing mechanism region 418 configured to receive at least a portion of the biasing mechanism 324. As also shown, the actuated portion 406 extends from the base region 410 of the actuation portion 408 in a direction opposite the first and second legs 412 and 414. As such, in some instances, the latch 318 may be described as generally having a Y-shape. In some instances, a first tab 413 may extend from the first leg 412 and a second tab 415 may extend from the second leg 414. The first and second tabs 413 and 415 may be configured to selectively engage corresponding latch catches 322 (FIG. 3). As shown, the filter cover 210 has a generally arcuate shape and, in some instances, the latch 318 may have a corresponding arcuate shape.

The base region 410 may include one or more sloped shoulders 420 that are sloped in a direction extending generally along the separation axis 416 (or generally away from the latch axis 320). For example, the base region 410 may include a plurality of sloped shoulders 420, wherein each sloped shoulder 420 extends over at least a portion of a corresponding one of the first or second leg 412 or 414. The one or more sloped shoulders 420 may be configured to encourage sliding of the latch 318 within the latch cavity 400 (e.g., by mitigating a risk of binding).

As shown, the latch cavity 400 may have a first latch cavity width 422 and a second latch cavity width 424, the first latch cavity width 422 being less than the second latch cavity width 424. For example, the second latch cavity width 424 may be at least two times greater than the first latch cavity width 422. The first latch cavity width 422 may generally correspond to a maximum width of the actuated portion 406 of the latch 318 and the second latch cavity width 424 may generally correspond to a maximum width of the actuation portion 408 of the latch 318. In some instances, the latch cavity 400 may have one or more cavity sloped regions 426 that correspond to a respective one of the one or more sloped shoulders 420.

Figure 5:
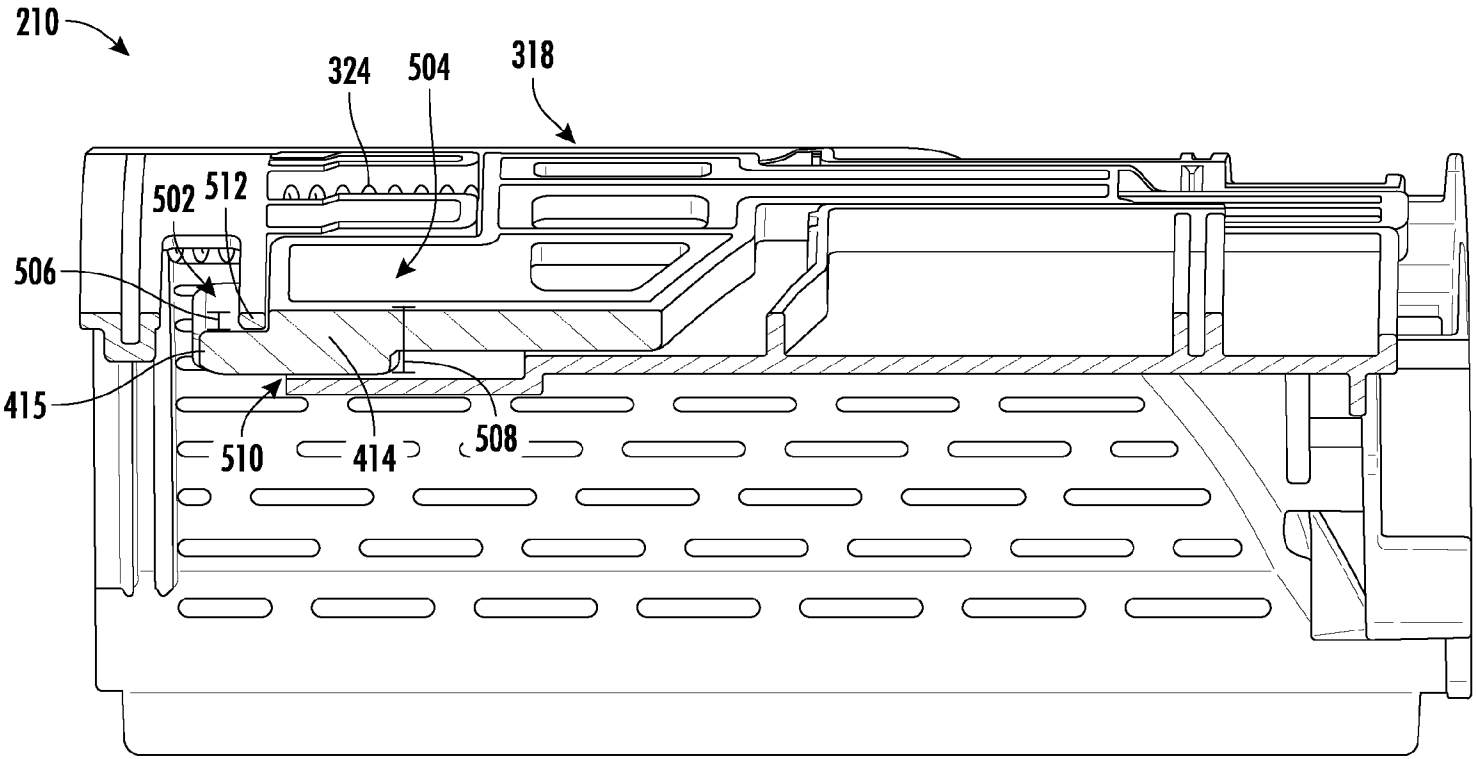
FIG. 5 shows a cross-sectional view of a portion of the filter cover of FIG. 4, consistent with embodiments of the present disclosure.

FIG. 5 shows a cross-sectional view of the filter cover 210 having the overlay 402 removed therefrom for clarity. As shown, the second tab 415 extends from the second leg 414 (the first tab 413 may be similar to the second tab 415). The second tab 415 includes a tab top surface 502 that is offset from a leg top surface 504 of the second leg 414 by an offset distance 506. The offset distance 506 may be, for example, at least a third, at least a quarter, or at least an eighth of a maximum leg thickness 508.

The second tab 415 is configured to at least partially extend from the latch cavity 400 to engage a corresponding latch catch 322 (FIG. 3). For example, at least a portion of the second tab 415 may extend through a cavity opening 510 extending within one or more sidewalls 512 defining the latch cavity 400. The biasing mechanism 324 may bias the latch 318 in a direction that urges the first and second tabs 413 and 415 out of engagement with the corresponding latch catches 322. The first tab 413 may have substantially similar configuration as the second tab 415.

Figure 6:
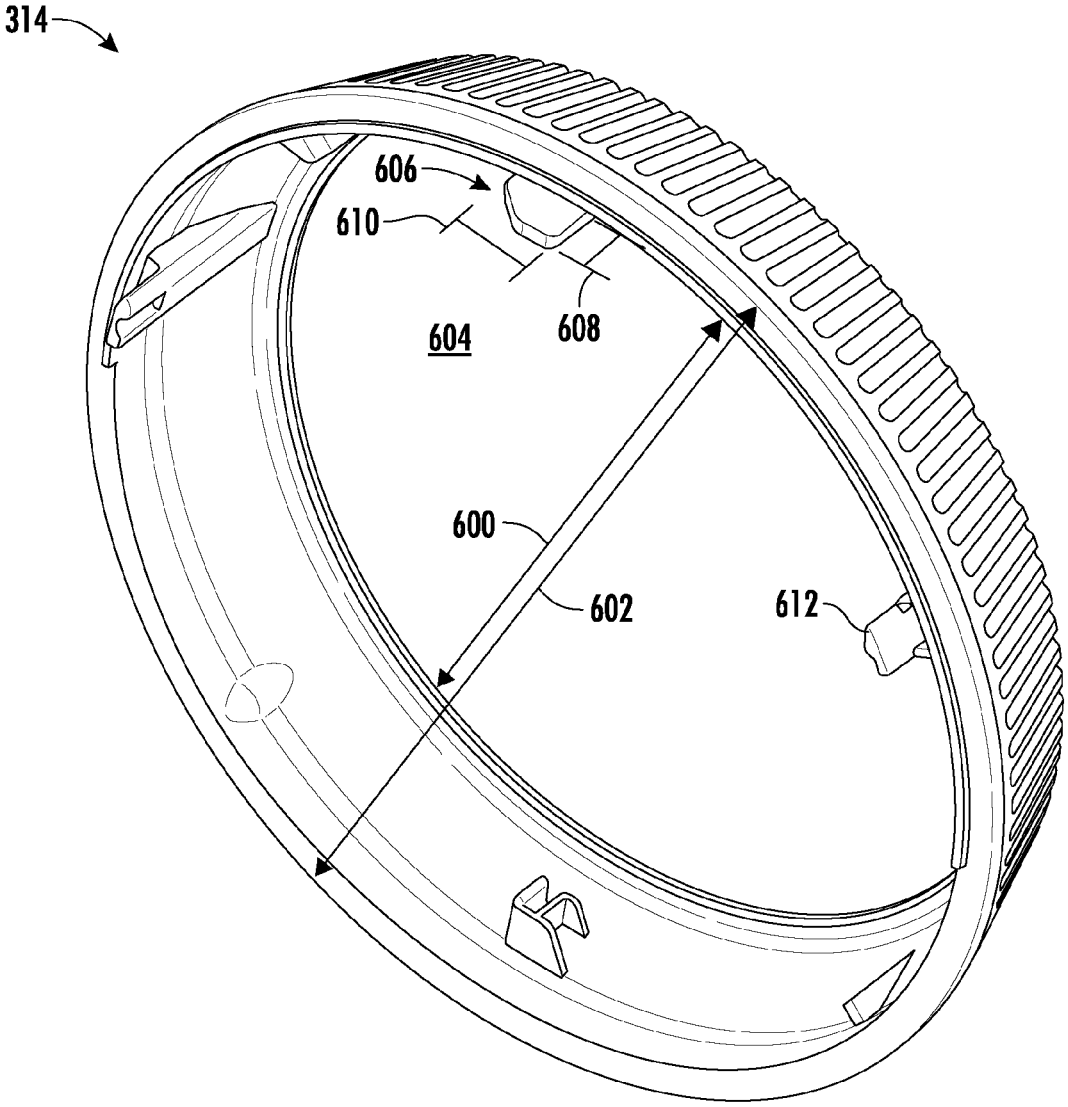
FIG. 6 shows a perspective view of a rotation ring of the vacuum cleaner of FIG. 2, consistent with embodiments of the present disclosure.
Figure 6A:
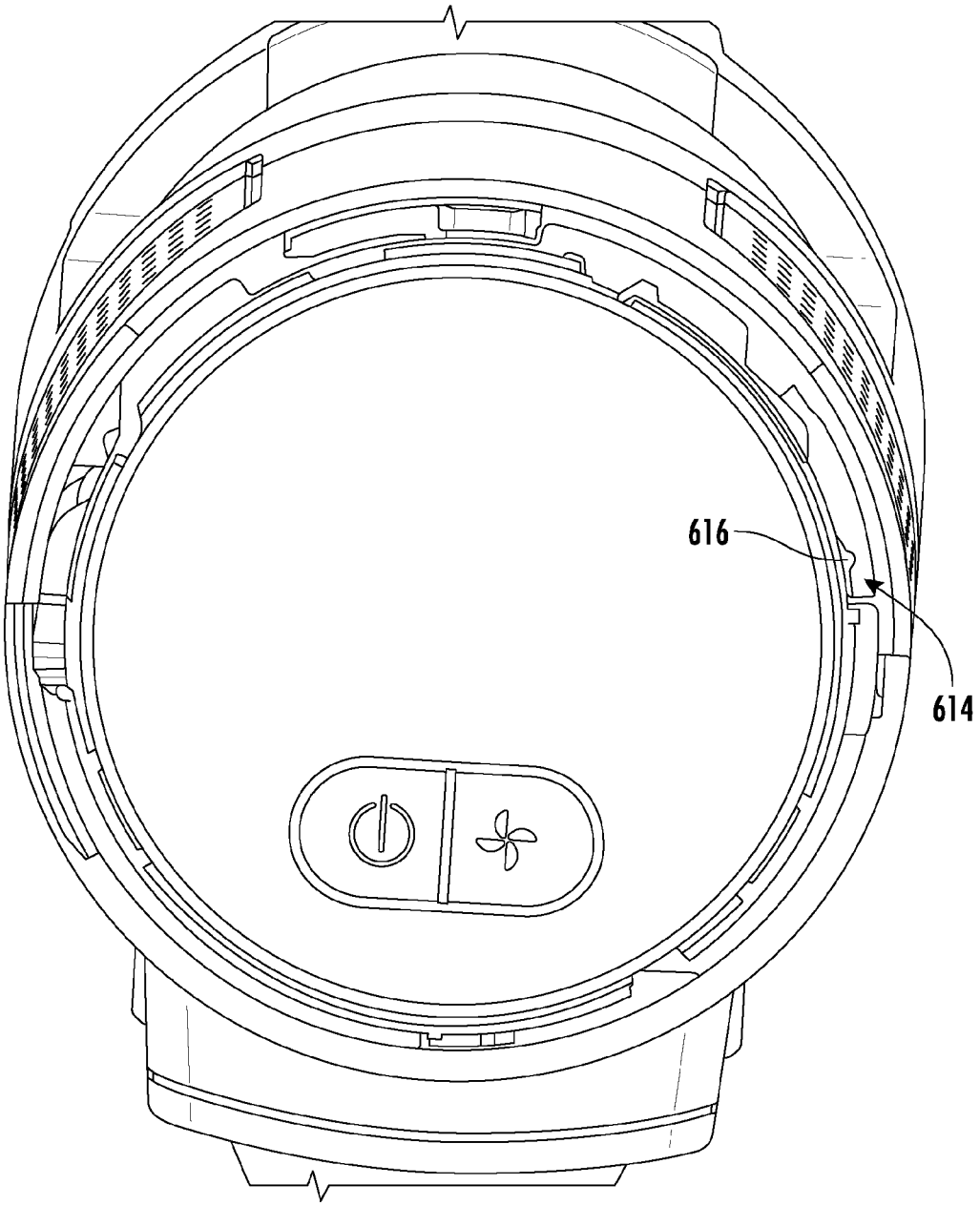
FIG. 6A shows a perspective view of the vacuum cleaner of FIG. 2 having the rotation ring of FIG. 6 removed therefrom, consistent with embodiments of the present disclosure.

FIG. 6 shows a perspective view of the rotation ring 314. As shown, the rotation ring 314 has an inner diameter 600 and an outer diameter 602 and defines an open area 604. The open area 604 may be configured to receive at least a portion of the body 300 (FIG. 3). As also shown, the protrusion 312 may include one or more protrusion sloped regions 606 such that a protrusion length 608 is non-constant along at least a portion of a protrusion width 610. The rotation ring 314 may also include one or more rotation guides 612 configured to guide a rotation of the rotation ring 314 about the actuation rotation axis 316. For example, the one or more rotation guides 612 may be received within a corresponding track 614 (FIG. 6A) defined within the body 300. The track 614 may include a detent 616 configured to resist (without preventing) an initial rotation of the rotation ring 314. Such a configuration may prevent an accidental rotation of the rotation ring 314. In some instances, the one or more rotation guides 612 may be configured to engage a biasing mechanism.

Figure 7:
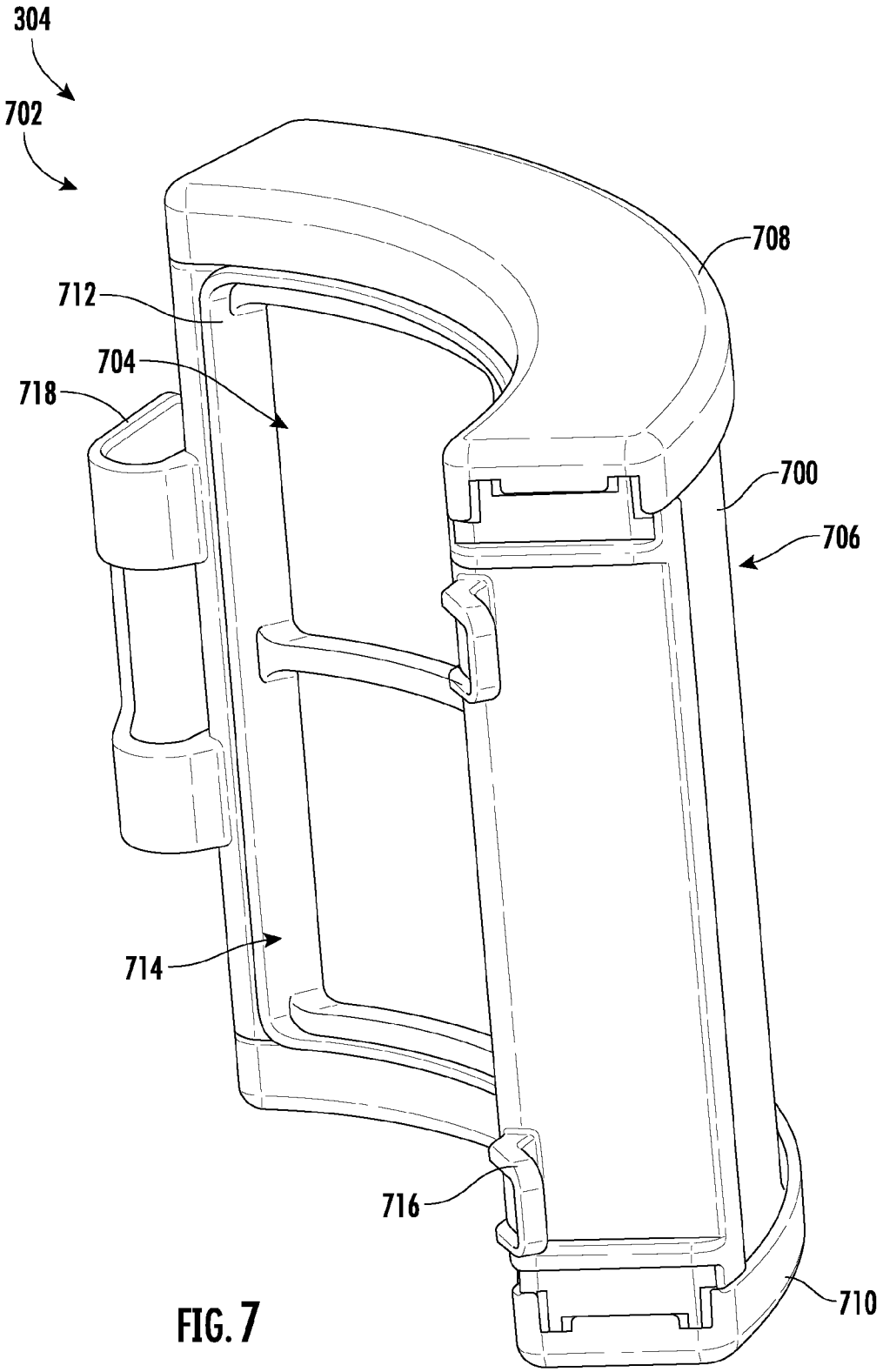
FIG. 7 shows a perspective view of a filter of the vacuum cleaner of FIG. 2, consistent with embodiments of the present disclosure.

FIG. 7 shows a perspective view of the filter 304. As shown, the filter 304 includes a filter medium 700 (e.g., a pleated filter medium) coupled to a filter frame 702. The filter medium 700 may be a HEPA filter medium. In some instances, and as shown, the filter 304 may have an arcuate shape.

The filter medium 700 has a dirty air side 704 and a clean air side 706 opposite the dirty air side 704. The filter frame 702 includes a first end cap 708, a second end cap 710, and a filter support 712 extending between the first and second end caps 708 and 710. The filter support 712 extends along the dirty air side 704 of the filter medium 700 and includes one or more air passthroughs 714. The filter support 712 may also include one or more retention protrusions 716 and at least one sprung retainer 718. The one or more retention protrusions 716 are configured to be received within a corresponding receptacle in the body 300 (FIG. 3) and the at least one sprung retainer 718 may be configured to urge the one or more retention protrusions 716 into the corresponding receptacles.

Figure 8:
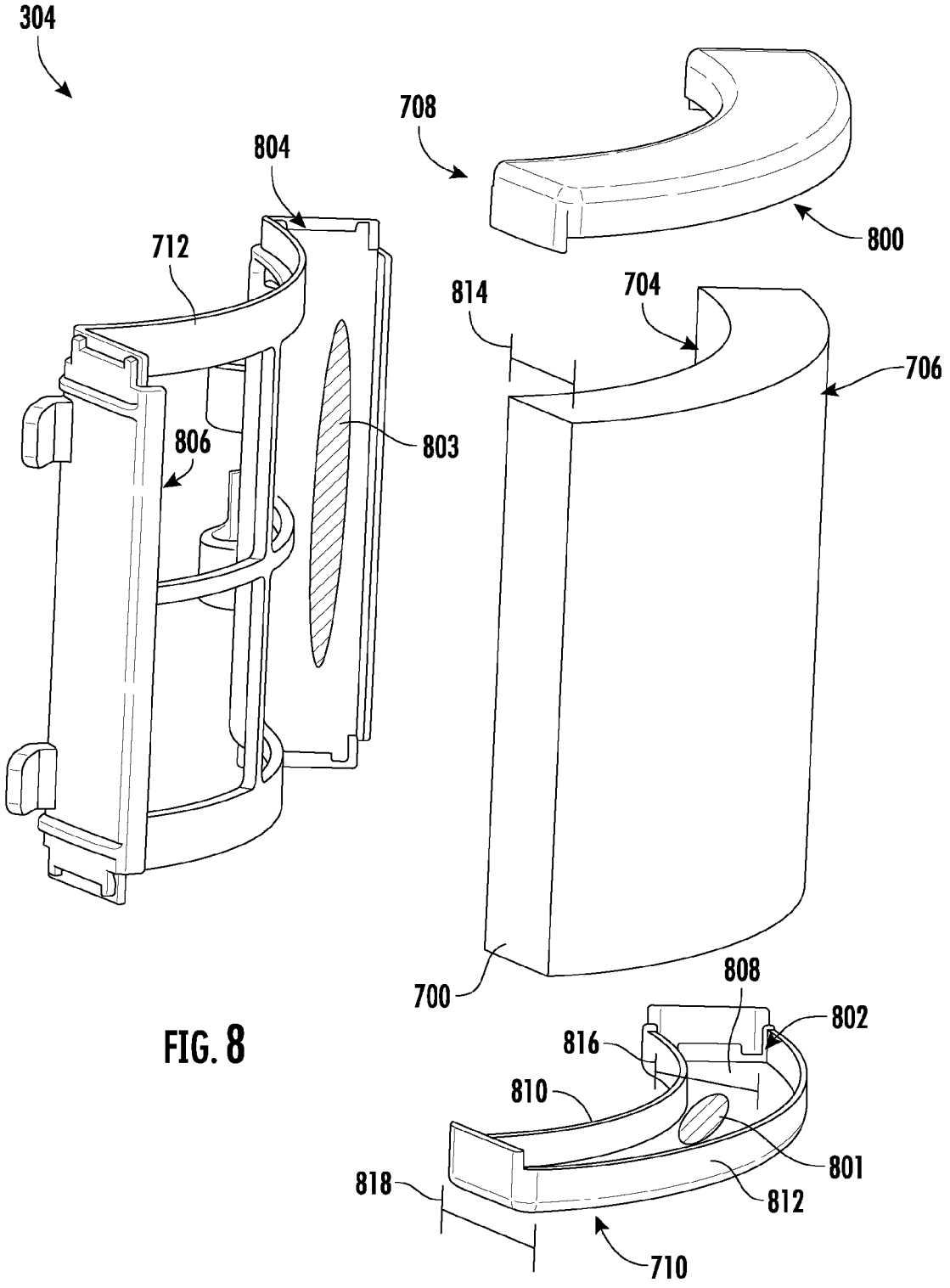
FIG. 8 shows an exploded view of the filter of FIG. 7, consistent with embodiments of the present disclosure.

FIG. 8 shows an exploded view of the filter 304. As shown, each of the first and second end caps 708 and 710 define a filter cavity 800 and 802 for receiving a portion of the filter medium 700. In some instances, the filter medium 700 may be adhesively coupled to the end caps 708 and 710 using a cap adhesive 801 disposed within the filter cavities 800 and 802. For example, the cap adhesive 801 disposed within the end caps 708 and 710 may be a two-part adhesive such as an epoxy resin mixed with a polyfunctional hardener.

The filter support 712 includes first and second coupling surfaces 804 and 806 on opposing sides of the filter support 712. At least a portion of the first and second coupling surfaces 804 and 806 extend between at least a portion of the first and second end caps 708 and 710. The first and second coupling surfaces 804 and 806 of the filter support 712 may be adhesively coupled to the filter medium 700 using a support adhesive 803. For example, the support adhesive 803 coupling the filter medium 700 to the first and second coupling surfaces 804 and 806 may be a hot melt adhesive.

In some instances, the cap adhesive 801 coupling the filter medium 700 to the end caps 708 and 710 may be different from the support adhesive 803 coupling the filter medium 700 to the filter support 712. For example, the cap adhesive 801 coupling the filter medium 700 to the end caps 708 and 710 may be a two-part adhesive such as an epoxy resin mixed with a polyfunctional hardener and the support adhesive 803 coupling the filter medium 700 to the filter support 712 may be a hot melt adhesive.

As also shown, the second end cap 710 (the first end cap 708 may have a similar configuration) has a mounting sidewall 808, a first support sidewall 810 extending from the mounting sidewall 808, and a second support sidewall 812 extending from the mounting sidewall 808. The first support sidewall 810 extends along the dirty air side 704 of the filter medium 700 and the second support sidewall 812 extends along the clean air side 706 of the filter medium 700. The filter medium 700 extends from the first support sidewall 810 to the second support sidewall 812. In some instances, the filter medium 700 may directly contact both the first support sidewall 810 and the second support sidewall 812. The cap adhesive 801 may be disposed between the filter medium 700 and the mounting sidewall 808. Such a configuration, may allow the cap adhesive 801 to fill in gaps between the filter medium 700 and the sidewalls 808, 810, and 812 of the second end cap 710 while allowing the filter medium 700 to extend from the first support sidewall 810 to the second support sidewall 812 (which may maximize the surface area of the filter medium 700). In other words, a filter medium thickness 814 of the filter medium 700 may generally correspond to (e.g., be within 1% of, 2% of, 3% of, 4% of, or 5% of) a sidewall separation distance 816 extending between the first and second support sidewalls 810 and 812. The filter medium thickness 814 extends from the dirty air side 704 to the clean air side 706 of the filter medium 700. The filter medium thickness 814 may be, for example, about (e.g., be within 1% of, 2% of, 3% of, 4% of, or 5% of) 10.7 millimeters (mm). An end cap thickness 818 may be, for example, about 15 mm.

The cap adhesive 801 may be a two-part adhesive such as an epoxy resin mixed with a polyfunctional hardener to allow time for the filter medium 700 to be positioned within the second end cap 710 before the adhesive cures. When assembling the filter 304, the filter medium 700 may, for example, be adhesively coupled to the filter support 712 before being adhesively coupled to the first and second end caps 708 and 710. If a pleated filter medium 700 is used, a hot melt adhesive may be applied across the pleats before the filter medium 700 is coupled to the filter support 712, which may increase a rigidity of the filter medium 700.

Figure 9:
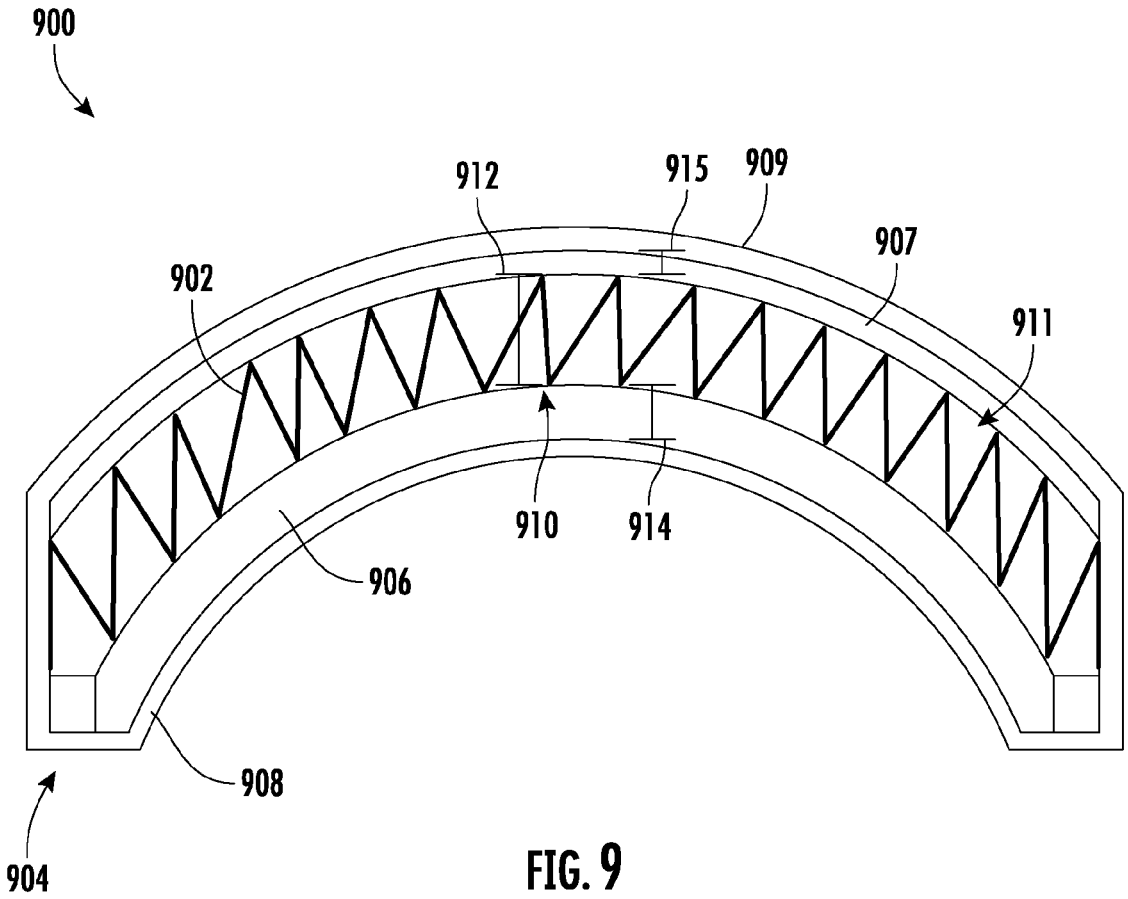
FIG. 9 shows a cross-sectional schematic view of a filter, consistent with embodiments of the present disclosure.

FIG. 9 shows a schematic example of a filter 900 having a filter medium 902 and an end cap 904. As shown, a first adhesive 906 extends along a first sidewall 908 and a second adhesive 907 extends along a second sidewall 909. The first sidewall 908 extends along a dirty air side 910 of the filter medium 902 and the second sidewall 909 extends along a clean air side 911 of the filter medium 902. As such, a filter thickness 912 is limited by a first adhesive thickness 914 and/or a second adhesive thickness 915, which may reduce a total surface area of the filter 900 (when compared to the filter 304 of FIG. 7). For example, the filter 304 may have about 37.5% more effective filtration area when compared to the filter 900 (assuming the filters 304 and 900 have substantially the same overall dimensions). The filter thickness 912 may be, for example, 7.5 mm, the first adhesive thickness 914 may be about 3.5 mm, and the second adhesive thickness 915 may be about 1.5 mm.

An example of a vacuum cleaner, consistent with the present disclosure, includes a suction motor, a body defining a filter cavity, the filter cavity being fluidly coupled to the suction motor and configured to receive a filter, a filter cover removably coupled to the body, the filter cover extending over at least a portion of the filter cavity, and a release configured to transition between a releasing position and a retaining position to removably couple the filter cover to the body. The release includes a body release portion, at least a portion of the body release portion being rotatably coupled to the body and a cover release portion, at least a portion of the cover release portion being slidably coupled to the filter cover, wherein a rotational movement of the body release portion causes a corresponding linear movement in the cover release portion to transition the release between the releasing position and the retaining position.

In some instances, the cover release portion may include a latch and the filter cover may include a latch cavity, the latch being slidable within the latch cavity. In some instances, the latch may include an actuated portion configured to engage the body release portion and an actuation portion configured to selectively engage with the body, the latch being configured to slide within the latch cavity in response to the body release portion being rotated. In some instances, the actuation portion may include a first leg and a second leg, the first leg being spaced apart from the second leg. In some instances, a first tab may extend from the first leg and a second tab may extend from the second leg. In some instances, at least a portion of the first tab and at least a portion of the second tab may be configured to selectively engage a corresponding latch catch of the body. In some instances, a tab top surface of the second tab may be offset from a leg top surface of the second leg. In some instances, the latch may be biased in a direction that urges the first tab and the second tab out of engagement with the corresponding latch catches.

Another example of a vacuum cleaner, consistent with the present disclosure may include a suction motor, a body defining a filter cavity, the filter cavity being fluidly coupled to the suction motor, a filter disposed within the filter cavity, a filter cover removably coupled to the body, the filter cover extending over at least a portion of the filter, and a release configured to transition between a releasing position and a retaining position to removably couple the filter cover to the body. The release may include a body release portion, at least a portion of the body release portion being rotatably coupled to the body and a cover release portion, at least a portion of the cover release portion being slidably coupled to the filter cover, wherein a rotational movement of the body release portion causes a corresponding linear movement in the cover release portion to transition the release between the releasing position and the retaining position.

In some instances, the cover release portion may include a latch and the filter cover may include a latch cavity, the latch being slidable within the latch cavity. In some instances, the latch may include an actuated portion configured to engage the body release portion and an actuation portion configured to selectively engage with the body, the latch being configured to slide within the latch cavity in response to the body release portion being rotated. In some instances, the actuation portion may include a first leg and a second leg, the first leg being spaced apart from the second leg. In some instances, a first tab may extend from the first leg and a second tab may extend from the second leg. In some instances, at least a portion of the first tab and at least a portion of the second tab may be configured to selectively engage a corresponding latch catch of the body. In some instances, a tab top surface of the second tab may be offset from a leg top surface of the second leg. In some instances, the latch may be biased in a direction that urges the first tab and the second tab out of engagement with the corresponding latch catches. In some instances, the filter may include a filter medium having a dirty air side and a clean air side, a filter support extending along the dirty air side of the filter medium, a first end cap, and a second end cap, the first and second end caps being disposed at opposing ends of the filter support. In some instances, the filter medium may be coupled to the filter support using a support adhesive and the filter medium may be coupled to the first end cap and the second end cap using a cap adhesive, the cap adhesive being different from the support adhesive. In some instances, the first end cap may include a mounting sidewall, a first support sidewall extending from the mounting sidewall and extending along the dirty air side of the filter medium, and a second support sidewall extending from the mounting sidewall and along the clean air side of the filter medium. In some instances, a filter medium thickness of the filter medium may generally correspond to a sidewall separation distance between the first support sidewall and the second support sidewall.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaner comprising:

an air inlet;

an air outlet;

a suction motor fluidly coupled to the air inlet and the air outlet such that the air inlet is upstream of the suction motor and the air outlet is downstream of the suction motor;

a body defining a filter cavity, the filter cavity being fluidly coupled to the suction motor at a location downstream of the suction motor and upstream of the air outlet, the filter cavity being configured to receive a filter;

a filter cover removably coupled to the body, the filter cover extending over at least a portion of the filter cavity; and a release configured to transition between a releasing position and a retaining position to removably couple the filter cover to the body, the release including:

a body release portion, at least a portion of the body release portion being rotatably mounted on the body; and a cover release portion, at least a portion of the cover release portion being slidably mounted on the filter cover, wherein a rotational movement of the body release portion causes a corresponding linear movement in the cover release portion to transition the release from the releasing position to the retaining position.

2. The vacuum cleaner of claim 1, wherein the cover release portion includes a latch and the filter cover includes a latch cavity, the latch being slidable within the latch cavity.

3. The vacuum cleaner of claim 2, wherein the latch includes an actuated portion configured to engage the body release portion and an actuation portion configured to selectively engage with the body, the latch being configured to slide within the latch cavity in response to the body release portion being rotated.

4. The vacuum cleaner of claim 3, wherein the actuation portion includes a first leg and a second leg, the first leg being spaced apart from the second leg.

5. The vacuum cleaner of claim 4, wherein a first tab extends from the first leg and a second tab extends from the second leg.

6. The vacuum cleaner of claim 5, wherein at least a portion of the first tab and at least a portion of the second tab are configured to selectively engage a corresponding latch catch of the body.

7. The vacuum cleaner of claim 6, wherein the latch is biased in a direction that urges the first tab and the second tab out of engagement with the corresponding latch catches.

8. The vacuum cleaner of claim 1 further comprising a dust cup fluidly coupled to the suction motor and the air inlet at a location upstream of the suction motor and downstream of the air inlet.

9. A vacuum cleaner comprising:

an air inlet;

an air outlet;

a suction motor fluidly coupled to the air inlet and the air outlet such that the air inlet is upstream of the suction motor and the air outlet is downstream of the suction motor;

a body defining a filter cavity, the filter cavity being fluidly coupled to the suction motor at a location downstream of the suction motor and upstream of the air outlet;

a filter disposed within the filter cavity;

a filter cover removably coupled to the body, the filter cover extending over at least a portion of the filter; and a release configured to transition between a releasing position and a retaining position to removably couple the filter cover to the body, the release including:

a body release portion, at least a portion of the body release portion being rotatably mounted to the body; and a cover release portion, at least a portion of the cover release portion being slidably mounted to the filter cover, wherein a rotational movement of the body release portion causes a corresponding linear movement in the cover release portion to transition the release from the releasing position to the retaining position.

10. The vacuum cleaner of claim 9, wherein the cover release portion includes a latch and the filter cover includes a latch cavity, the latch being slidable within the latch cavity.

11. The vacuum cleaner of claim 10, wherein the latch includes an actuated portion configured to engage the body release portion and an actuation portion configured to selectively engage with the body, the latch being configured to slide within the latch cavity in response to the body release portion being rotated.

12. The vacuum cleaner of claim 11, wherein the actuation portion includes a first leg and a second leg, the first leg being spaced apart from the second leg.

13. The vacuum cleaner of claim 12, wherein a first tab extends from the first leg and a second tab extends from the second leg.

14. The vacuum cleaner of claim 13, wherein at least a portion of the first tab and at least a portion of the second tab are configured to selectively engage a corresponding latch catch of the body.

15. The vacuum cleaner of claim 14, wherein the latch is biased in a direction that urges the first tab and the second tab out of engagement with the corresponding latch catches.

16. The vacuum cleaner of claim 9, wherein the filter includes a filter medium having a dirty air side and a clean air side, a filter support extending along the dirty air side of the filter medium, a first end cap, and a second end cap, the first and second end caps being disposed at opposing ends of the filter support.

17. The vacuum cleaner of claim 16, wherein the filter medium is coupled to the filter support using a support adhesive and the filter medium is coupled to the first end cap and the second end cap using a cap adhesive, the cap adhesive being different from the support adhesive.

18. The vacuum cleaner of claim 16, the first end cap includes a mounting sidewall, a first support sidewall extending from the mounting sidewall and extending along the dirty air side of the filter medium, and a second support sidewall extending from the mounting sidewall and along the clean air side of the filter medium.

19. The vacuum cleaner of claim 18, wherein a filter medium thickness of the filter medium generally corresponds to a sidewall separation distance between the first support sidewall and the second support sidewall.

20. The vacuum cleaner of claim 9 further comprising a dust cup fluidly coupled to the suction motor and the air inlet at a location upstream of the suction motor and downstream of the air inlet.

* * * * *